US007048638B2

(12) United States Patent
Novotny

(10) Patent No.: US 7,048,638 B2
(45) Date of Patent: May 23, 2006

(54) CONSTANT FORCE GOLF SWING TRAINING DEVICE, METHOD OF SWING PLANE TRAINING AND INTERNET OPERATION THEREOF

(76) Inventor: Milo R. Novotny, 142 D Hilltop Dr., Sequim, WA (US) 98382

( * ) Notice: Subject to any disclaimer, the term of this patent is extended or adjusted under 35 U.S.C. 154(b) by 447 days.

(21) Appl. No.: 10/313,679

(22) Filed: Dec. 6, 2002

(65) Prior Publication Data

Related U.S. Application Data

(60) Provisional application No. 60/339,138, filed on Dec. 7, 2001.

(51) Int. Cl.
*A63B 69/36* (2006.01)

(52) U.S. Cl. ..... 473/219; 473/229; 473/257; 482/129; 434/252

(58) Field of Classification Search ..... 473/219, 473/221, 222, 142, 206, 213, 218, 229, 422, 473/458, 461, 230, 233; 482/94, 129, 127, 482/122, 121, 114
See application file for complete search history.

(56) References Cited

U.S. PATENT DOCUMENTS

| | | | | |
|---|---|---|---|---|
| 1,137,349 | A | 4/1915 | Patterson | |
| 2,848,234 | A | 8/1958 | Brandon | |
| 3,462,156 | A | 8/1969 | Gentry | |
| 4,135,714 | A | 1/1979 | Hughes | |
| 4,229,002 | A | 10/1980 | Masters | |
| 4,253,663 | A * | 3/1981 | Hughes | 482/127 |
| 5,082,262 | A * | 1/1992 | Sanchez | 473/458 |
| 5,269,512 | A | 12/1993 | Crowson | |
| 5,816,928 | A | 10/1998 | Colonna | |
| 5,947,835 | A | 9/1999 | Fenton, Jr. | |
| 5,984,797 | A | 11/1999 | Kessler | |
| 6,159,016 | A * | 12/2000 | Lubell et al. | 434/247 |
| 6,277,030 | B1 | 8/2001 | Baynton | |
| 6,293,875 | B1 | 9/2001 | Sanford | |
| 6,312,345 | B1 | 11/2001 | Pelz | |
| 6,413,196 | B1 | 7/2002 | Crowson | |
| 6,431,991 | B1 | 8/2002 | Kossnar | |
| 6,537,184 | B1 * | 3/2003 | Kim | 482/122 |
| 6,558,302 | B1 * | 5/2003 | Cluff | 482/129 |
| 6,648,780 | B1 * | 11/2003 | Boldin | 473/461 |
| 2002/0025891 | A1 * | 2/2002 | Colosky et al. | 482/127 |

* cited by examiner

*Primary Examiner*—Xuan M. Thai
*Assistant Examiner*—Alex F. R. P. Rada, II
(74) *Attorney, Agent, or Firm*—Innovation Law Group, Ltd.; Jacques M. Dulin, Esq.

(57) ABSTRACT

Golf swing training device having constant resistive and rewind forces throughout the swings. An anchor positions a constant force unit, supplies a tether to a special contoured handle and is used indoor or out, preferably at a driving range or golf course. The CFU is preferably hung from a door top by a bracket or anchored to a free-standing pole. Kiosks may be located at driving ranges and golf courses for automated, coin or credit-card operation, or attendant operation, and may be linked to local or remote Internet-enabled computer control and monitoring centers. The use of constant force trains the body to learn perfect planar swing muscle memory by pulling the user into a fully-extended back swing position and to be lead side dominant in the down swing. A "perfect" club swing plane is developed with the force acting at or near the interlock by use of the special handles.

21 Claims, 9 Drawing Sheets

120
33
A

122
A
33

33
122
11
10
11

A
12
14
13
B

11
A
14

12
10
11
8
124
8

10
11
126
8
8

10
11
8
128
8

11
10
10
48
8
46

CONSTANT FORCE GOLF SWING TRAINING DEVICE, METHOD OF SWING PLANE TRAINING AND INTERNET OPERATION THEREOF

CROSS-REFERENCE TO RELATED CASE

This is the Regular U.S. Application of U.S. Provisional Application Ser. No. 60/339,138, filed 7 Dec. 2001, and corresponds to PCT Application PCT/US02/39043 filed Dec. 6. 2002, published us WO 03/049815 on 19 Jun. 2003, incorporated by reference herein and the priority of each of which applications is claimed under 35 U.S. Code §§119, 120 and 365 and related treaties.

FIELD OF THE INVENTION

The invention relates to the sport of golf, and includes a number of important aspects including a device to improve the golf swing of the player, more particularly to a constant force system that assists the user in developing a correct backswing, downswing and follow through. The invention also includes methods of swing plane training and internet-based management that permits the inventive devices to be operated on a "training time" subscription or rental basis.

BACKGROUND

The very popular sport of golf entails a very complex motion to swing a golf club so as to either propel a golf ball a maximum distance in a desired direction, or to propel the golf ball a carefully controlled distance in a precisely determined direction. Almost all golf players strive to improve their skill at the game, and improved skill generally leads to increased enjoyment of the game.

Despite the complexity of the golf swing, the usual game of golf typically entails a relatively small number of swings or strokes, generally in the range of 70 to 100 or so, and about a third of these are putting strokes that require an entirely different technique. Because of variations in topography on a golf course, few of the remaining swings are the truly repetitive swings needed for skill improvement. Thus even the most dedicated of golf players must usually resort to off-course practice to improve their golf skills.

Many golf players make use of golf driving ranges, which allow the player to practice repetitive swings under virtually identical conditions. While such practice is undoubtedly valuable, it requires a trip, sometimes of some considerable distance, to a golf driving range. Furthermore, simple repetition, as at a driving range, does not assure that the swing is being performed correctly. As a result, many golf training devices have been developed for use in the home (or the garage or backyard) to assist a golf player to improve his/her golf skill. See, for example: Sanford, U.S. Pat. No. 6,293,875; Pelz, U.S. Pat. No. 6,312,345; Bayton et al., U.S. Pat. No. 6,277,030; Kessler et al., U.S. Pat. No. 5,984,797; and Kossnar et al. U.S. Pat. No. 6,431,991. Many of the training devices of the art are quite complex and expensive.

Brandon, in U.S. Pat. No. 2,848,234, teaches a golf-swing conditioner comprising an extensible elastic member terminating at one end in a golf-club-like handle, and terminating at the other end in a screw-eye or similar means for attachment to a stationary surface. The device taught by Brandon is designed to allow a user to practice his/her golf swing, and to condition the muscles employed in the golf swing, against the resistance provided by the elastic extensible member. The invention of Brandon lacks any features that would serve to induce or constrain the user to correctly perform the critically important backswing and downswing phases of a golf swing.

Fenton, in U.S. Pat. No. 5,947,835, teaches a golf swing exerciser and trainer device also comprising an extensible elastic member terminating in a golf-club-like handle, the other end of the device of Fenton being adapted to allow attachment to a stationary device such as a door knob. Like the device of Brandon, the device taught by Fenton also lacks any features which would serve to induce and constrain the user to correctly perform the critically important back swing and down swing phases of a golf swing.

Another approach to golf swing training is shown in U.S. Pat. No. 5,984,797 (Kessler et al.) and U.S. Pat. No. 6,431,991 (Kossnar et al.). The complex device of these related patents involves a pelvic belt that wraps around the golfer's hips and guides the golfer's pivot during the swing. A relatively complex and costly adjustable, dual axis mechanism constrains and guides the pelvis in a first axis in the back and downswings, and in a second axis in the follow through. Although this device addresses the pelvic rotation and weight shift during the swing, it does not address the development of a proper swing plane, arm extension, wrist positioning or the development of the proper pull-through of the opposite, lead shoulder and hip. That is, golf for a right-handed player is a left side game, and for a left-handed player is a right side game. Since the opposite side is not the dominant side for the player, having the opposite side (predominantly the shoulder) be the key is counter-intuitive, intellectually and consciously. Correspondingly, it is difficult to develop the proper muscle memory to counter the natural dominant tendencies of the following side.

Learning or improving a complex physical task such as an optimum golf swing requires repetitive performance of the task, and involves the complex interaction of the muscular and nervous systems. In particular, repetitive feedback of nerve signals from proprioceptive receptors (nerves which sense position and/or pressure in a muscle, joint or other tissue) to the central nervous system result in "imprinting" the feedback on the central nervous system, until performance of the task becomes reflexive. This imprinting process is often referred to, although technically incorrectly, as "muscle memory".

This process is clearly illustrated in the process by which a child learns to walk, from the first tentative and awkward steps of a two-year old to the relaxed and graceful gait of three- or four-year old. The difficulty faced in relearning how to walk following an accident, injury or stroke illustrates the complexity and reflexive nature of walking. One does not have to think about how to perform and coordinate all of the muscular actions required to walk; ideally one should not have to think about how to correctly perform an athletic activity such as hitting a golf ball. Ideally, one should not have to be concerned with the result of the swing, i.e., where the golf ball is going, when attempting to learn and imprint the golf swing sequence. It is well understood in the sport that "The golf ball is the bane of the golf swing".

An optimal training device to improve an athletic skill would induce or constrain the user to perform the action of the skill in the correct or most advantageous manner, and allow the user to repetitively practice that action until it performing it correctly becomes automatic or reflexive. To quote an old saying, particularly applicable to golf, "Practice makes perfect only if you practice perfectly."

To be useful for the greatest possible number of golf players, a golf training device should also be inexpensive, should not occupy much space in the home when not in use, and should be quickly and easily set up for use, and quickly and easily disassembled after use.

Perfecting the golf backswing—the initial part of the golf swing, in which the golfer swings the golf club to a position above and in front of the trailing shoulder (the right shoulder for a right handed golfer) to begin the swing—is an often-neglected activity in efforts to improve one's golf skill, yet many golf teachers consider the backswing to be the key to a good golf swing. A consistently good swing cannot be developed if the backswing is poor or inconsistent. Therefore, there is a need for an effective training device to assist golfers in perfecting their backswing. Ideally, such a training device should also provide assistance in perfecting the downswing the phase of the golf swing immediately following the backswing, where the golfer brings the golf club down from the position at the top or end of the backswing to the position of impact on the golf ball. Such a device could thus assist golf players both in the perfection of their backswing and the transition to the downswing.

Furthermore, golf players, in striving to improve their golf swing, must learn to use their non-dominant arm and shoulder muscles to produce the major force of the golf swing, particularly of the downswing, and to counteract the tendency to let the dominant side take over. That is, a right-hand-dominant golf player must train himself/herself to use the left arm and shoulder to produce most of the power of the golf swing. Proper use of the non-dominant arm and shoulder must be imprinted on the golf player, and an ideal golf swing training device should assist the user in strengthening the musculature of the non-dominant side, and make the use of the non-dominant side, to provide most of the golf swing's power, a reflexive action. The dominant-side musculature does, of course, provide important power to the golf swing, in the impact and post-impact phases of the swing.

Accordingly, there is a significant and important unmet need in the field of golf training for proper golf swing plane training, and more particularly for a device and system that is simple yet effective and addresses the issues of development of muscle memory in the upper body for proper lead-side dominance to produce a smooth, consistent and controllable swing plane.

THE INVENTION

Summary, Including Objects and Advantages

The invention comprises in a first aspect a golf swing training device having a constant resistive force throughout the swings: the back swing from set up; the downswing to hit; and the follow through swing. The device includes an anchor for positioning and securing a constant force unit (herein abbreviated CFU), the CFU itself, a tether from the CFU to a special handle, and the handle unit itself that is contoured to provide the proper golf grip. Optionally the swing trainer device can include a foot placement system for locating the proper foot placement relative to the anchor and CFU for either or both a right handed or left handed golfer. The foot placement system can be realized in a wide variety of embodiments, described in more detail below, ranging from a placemat, to a template for marking foot placement, to stick-on sheet plastic foot prints with placement directions for adhering the foot prints the proper distance and angle from the anchor and CFU.

In the method aspect of the invention, the proper steps for use of the swing trainer device are set forth, for both the right handed and left handed golfer. In addition, the training method includes loosening-up and stretching exercises, that are useful not only for golfers, but also for users who find a need for a device that develops a greater range of rotational motion and arm extension, such as older persons, or persons requiring increased or rehabilitative range of motion exercises. The training method includes specific steps for the back swing, the down swing and the follow through, all of which can be practiced independently. In a first alternative, the swing training device is anchored in a position generally to the right or left side of the user, depending on which-handed he/she is, and the amount of force is selected for the age, sex or level of skill of the golfer. The back swing and down swing may be practiced sequentially, and the follow through separately.

The swing training device can be used indoor or out, in the home, garage, back yard, in a training facility such as an indoor golf training facility, an outdoor venue such as a driving range or adjacent a golf pro shop or golf pro training area or camp. In one embodiment the CFU is pivotally anchored to a wall with a plate. In another, the CFU can be hung from a door top by means of an inverted U-Shaped bracket or set of clamps. In still another embodiment the CFU can be anchored to a free-standing pole, such a pipe anchored in the ground, either permanently or by being removably mountable in a sleeve inset in the ground, or in a sleeve secured to a base plate anchored to the ground or other flooring surface such as asphalt, concrete or wood.

In the Internet-base business method aspect of the invention, one or more indoor or outdoor, anchored units or free standing pole units, can be coin or credit-card operated, with a local or remotely located programmable CPU to enable operation, including authorization for access and use, and tracking use by subscribers or walk-in trade for charge or billing purposes, and remittance of rents, royalties, commissions, etc., and for assessing use traffic history and profitability, among other management analytic tools. In another aspect, kiosks may be located at driving ranges and golf courses that are either attendant-operated or golf pro-operated, or are automated and linked to local (in-kiosk or at the place of business) computer controls and displays, or may be remotely linked by LAN, WAN or Internet to a remotely-located control and monitoring center. The links may be any conventional link: e.g., by telephone lines (local or long lines); dedicated DSL, SDSL, ADSL, ISDN, T1, Cable, etc.; or by tower-enabled or satellite Wireless or Internet linkage.

A number of different types of CFUs may be employed, including a weight system that can be raised/lowered or a constant force spring arrangement, preferably, a counter-wound ribbon spring system. The weight system may be a direct lift of a weight constrained to slide generally vertically in, on or around a guide rod, bar, pipe, tube or track, and thence over a pulley free to swivel in at least two axes, or a double pulley system. Counter-wound spring system may include a wide variety of spring winding arrangements, from single to multiple independent springs, or for multi-layered springs. One skilled in the art can select the spring force suitable for the particular application and cycle life desired. Typically, the spring force is 4–8 lbs for younger golfers, and 8–12 lbs for women, and 12–20 lbs for male golfers. In one preferred arrangement, multiple CFU spring systems are provided in a single housing so the user can select the constant force desired, including linking two different force systems to a single tether for an additive force effect. Thus, a 10 lb force reel may be linked to a 6 lb force reel to achieve a 16 lb restraining force. Brake systems may be used for "dial-in" resistive forces as long as the torque provided by braking results in constant force through the swing arc.

The purpose for using constant force in a golf swing plane trainer is to train the body to create a smooth transition from the top of the back swing to the impact position by simply turning the shoulders and keeping the arms extended in front of the body. The CFU forces selected provide a resistive force that is equivalent to the resistance of a golf club. The three main reasons for the use of constant force in training the body to learn the principles and achieve proper muscle memory of a perfect back swing and down swing that keeps the arms and hands in a true plane are: 1) a variable force, if properly adjusted for the end of the swing, would be too weak at the beginning of the swing to aid in fully extending the arms, shifting the weight and turning the shoulders; 2) if the force were to increase on the down swing, a gradual acceleration to the hitting or impact point could not be attained; and 3) when reaching the entry of the impact zone, a feeling of being able to release the "club" must be felt, rather than a requirement for more force to get to through the impact point.

Another important aspect of the invention is the provision of a wide variety of handles to which the extensible CFU tether is attached. The present invention provides a relatively short handle to which the tether to the CFU is attached. The user (golfer or trainee) grips the handle in the correct manner of a golf club, but the handle does not include the full club shaft and head. This permits use indoors in a confined space. In addition, and more importantly, the direction of force is along the tether at the entry to the impact zone on the down swing, which line extends through the center of the grip, i.e., the interlock of the hands. That is, the center of resistive force needs to be at or near the interlock, preferably at the center. With the force at or near the interlock, the inventive system provides a back swing pull, by virtue of the spring rewind function, that fully extends the arms. In addition, it tends to maintain a perfectly planar swing plane, in that any cocking of the wrists up or down such as would lift or lower a club out of the plane, meet resistance. That is, following the swing plane properly is following the path of most constant resistance, perceived to be the path of least resistance.

Thus the CFU provides a means for exerting a force on the handle to induce and constrain the user to raise the handle and turn his/her body to perform a correct or optimum back swing. The CFU then provides resistance to the practice down swing, thereby inducing and constraining the user to perform that phase of the golf swing correctly. The inventive training device is simple and inexpensive to manufacture, requires little space, is easily set up in an operative condition and easy to disassemble after use, or may be simply left in place since it takes up little room and is ordinarily mounted well above head height.

Accordingly, it is among the objects and advantages of the present invention to provide a golf training device to: a) assist the golfer in perfecting his/her backswing; b) assist the golfer in perfecting his/her downswing and the transition from backswing to downswing; c) induce and constrain the user to perform the practice backswing and downswing in an optimal and correct manner; d) assist the golfer in strengthening the musculature of the non-dominant side; and e) develop the proper use of the non-dominant side to provide the power necessary for an optimal and correct golf swing.

A key set of advantages and objectives of the inventive training device and method are: 1) It pulls the user into a perfect back swing position; 2) A club swing plane is developed with the force at the interlock to keep the "club" on and in the proper swing plane; and 3) It trains the body to be lead side dominant, left side for right handed golfers, and right side for lefties. That is, it develops lead side muscle memory, a process that includes change in the neural pathways of the brain. The rewind action of the CFU pulls the user into a perfect back swing position with fully extended arms and shoulders fully turned. In turn, this develops a longer arc with greater club head speed resulting in longer shots. The full, correct swing plane development leads to more consistency and accuracy in drives and iron shots.

For the follow through swing, the rewind action of the CFU likewise "pulls" the user in the continuation of the plane in this essentially "passive" part of the total swing.

Thus, when properly mounted and the training user is properly aligned with respect to the position of the CFU, the inventive system: 1) pulls the arms into a fully extended back swing position, keeping the arms in front of the body (the CFU relative to the use should not be behind the user); 2) turns the shoulders up to 90°, and assists in the limbering and warming-up by increasing the rotational angle; 3) aids in the weight transfer from the lead side to the "follow" side (right side in right handed golfers, the left side for lefties); 4) develops and instills a tempo that slows the transition form the back swing to the down swing, thus helping control the swing and helping the swing to stay on plane; 5) resists the swinging over or under the proper swing plane by increasing resistance when the line of force wanders outside, or does not intersect the interlock; it encourages a swing along the path of perceived least resistance; and 6) retrains the body to the lead side dominance.

As noted, right handed golfers tend to be right side dominant, meaning the right side of their body tends to take over and initiate the down swing. This is incorrect; the body must be trained to initiate the down swing with the lead arm and shoulder, the left side for right handed golfers, in order to keep the swing on the correct path. That is, the proper swing path is a pull-through path initiated and guided by the lead side, not a push path forced by the dominant following side. To be successful in golf, a right-handed golfer must switch his/her thinking from right to left, from dominant to lead. Of course, for a leftie, the thinking must be switched from left to right.

As a result of training repetitions under the control provided by the inventive constant force swing trainer for back and down swings, signals from the proprioceptive receptors in the various muscles, joints ligaments and tendons involved in the action leads to the imprinting of the correct sequence of movements on the central nervous system. This is accomplished by physical repetition of a proper swing path movement that changes the neuronal activity of the brain by changing the cellular structure and function of the effected area, also called "muscle memory".

BRIEF DESCRIPTION OF THE DRAWINGS

The several aspects of the invention are described in more detail with reference to the drawings, in which:

FIG. 2 is a series of perspectives showing the orientation and set up of the inventive swing plane trainer, and the proper positioning of the training user in the several swings, in which

FIG. 5 comprises a series of handle designs, all shown contoured, in which FIG. 5A shows a simple right angled swiveling tether link; FIG. 5B shows a shepherd crook link member in which the crook is bent in three dimensions; FIG. 5C shows a short, dual axis pivoting link member; FIG. 5D show a pivoting eyelet design for the link member; FIG. 5E shows a contoured, self-centering guide for the tether; FIG. 5F shows a fan-type tether guide; FIG. 5G shows a spring type tether link; and FIG. 5H shows a stirrup-type handle for warm-ups, limbering exercises and rehabilitation;

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and provisional or regular applications cited in this specification are herein incorporated by reference as if each individual publication, patent or application has been expressly stated to be incorporated by reference.

Generally, the device aspect of the present invention comprises a handle, similar to the handle of a golf club, which the user grasps; force-exerting means (CFU) that assists and guides the user to perform a correct back swing, and that provides resistance to the user in the down swing; and mounting means to support the CFU. The handle is connected to the force-exerting CFU means by an extensible tether that is stored on a reel in the CFU. The more detailed aspects of the invention will be shown by the specific embodiments described below.

Figure 1:
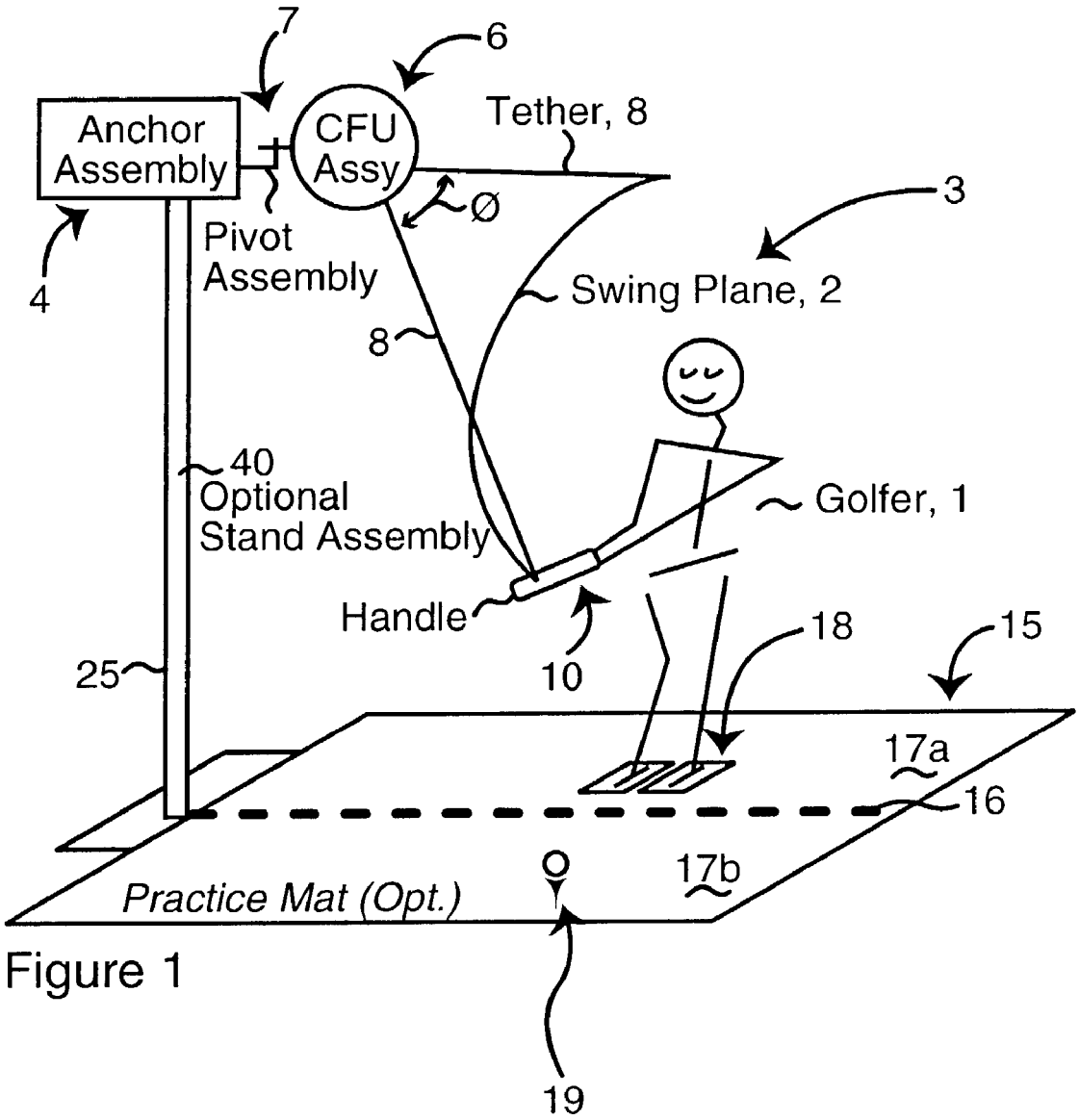
FIG. 1 is a schematic of the principal elements of the inventive swing plane trainer.

FIG. 1 is a schematic of the principal elements of the inventive swing plane trainer system 3 comprising an anchor assembly 4 to which a CFU assembly 6 is connected by a pivot assembly 7. The CFU includes a line, cable or cord-type tether 8, to which is attached a handle 10. The golfer/trainee 1 positions him/her self in a generally orthogonal orientation to the anchored CFU for practice of the back swing, the down swing and the follow through swing. As shown a right handed golfer stands on the right hand side 17*a* of a practice mat 15. The optional mat is generally divided by demarcation line 16, into a right side 17*a* and a left side 17*b*, for right and left handed golfers, respectively. The demarcation line assists in lining up the mat with the anchor assembly location so that the golfer is correctly positioned to look at a tee & ball 19, or a spot on the floor ("head spot") on which the golfer can focus during the practice. Foot position locators, such as foot outlines or footprints 18 can be provided on the mat to assure proper distance of the golfer away from the anchored CFU. The golfer grasps the handle and swings it along swing plane 2. The tether provides a constant force on the handle to help develop the proper swing plane, extension and lead side dominance training. An optional mounting assembly 40 may include a stand or pole 25 for free standing mounting out of doors. Of course it should be understood that instructions and legends can be printed on the mat 15, including labeling the sides 17*a* and 17*b* for the proper handedness of the golfer. For a left handed golfer, the foot positioning prints 18 are repeated on side 17*b* (not shown in FIG. 1), and a spot or tee & ball placed appropriately on half 17*a* may be provided.

Figure 2A:
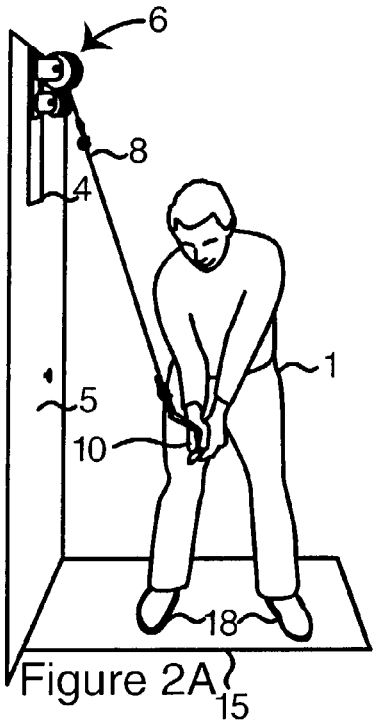
FIG. 2A shows a right-handed golfer at the initial "address" position.
Figure 2B:
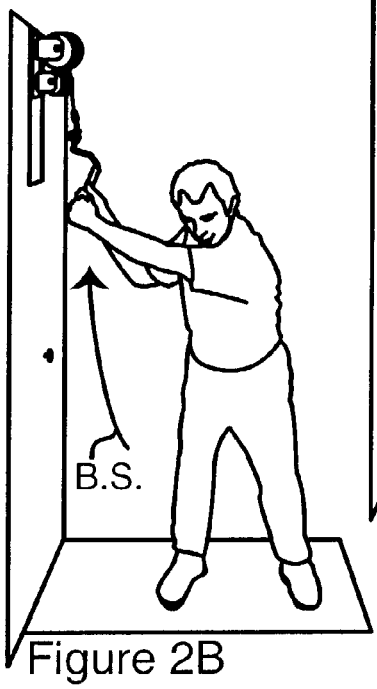
FIG. 2B shows the user at the full back swing position.
Figure 2C:
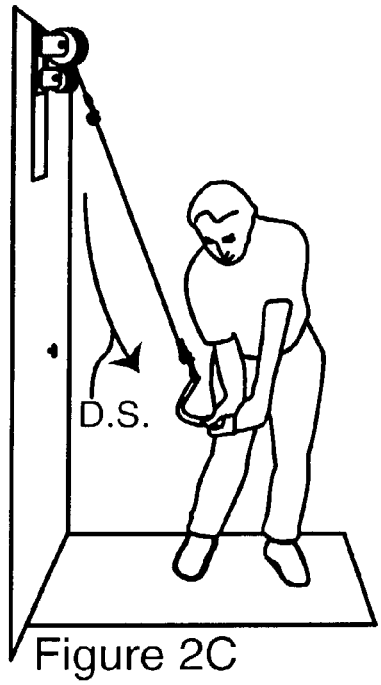
FIG. 2C shows the user at the position just entering the impact zone.
Figure 2D:
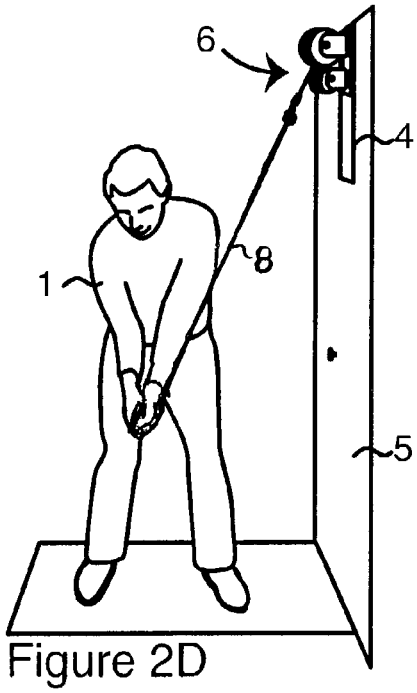
FIG. 2D shows the same user reversing position for the back swing, starting at the impact position.
Figure 2E:
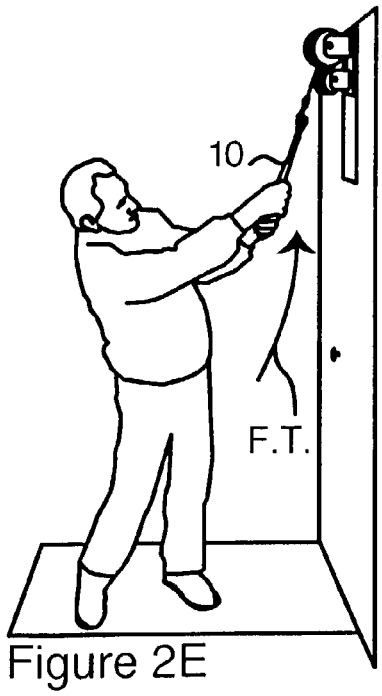
FIG. 2E shows the user at the full follow through position.
Figures 1, 2, 5A, 5B, 5C, 5D, 5E, 5F, 5G, 5H:
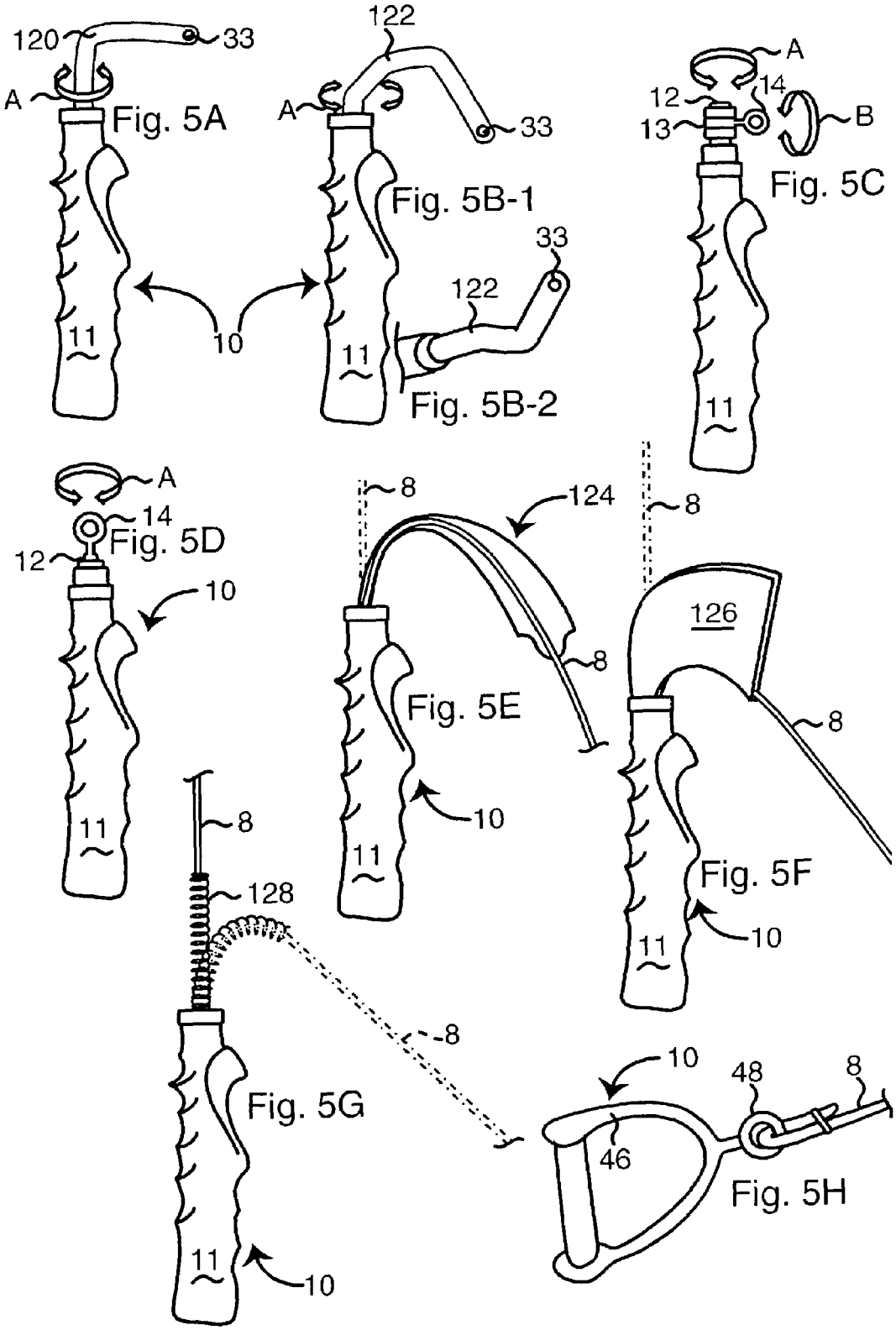

FIG. 2 is a series of five drawings comprising outlines of actual photos of a right handed golfer 1 in training, positioned orthogonal to a door 5 on which a CFU is mounted by an over-the-door bracket 4. He is standing on a mat 15 to position himself the proper distance from the door-mounted CFU, and grasps the handle 10 that is attached to the CFU via tether 8. These set of figures demonstrate the orientation and set up of the inventive swing plane trainer, and the proper positioning of the training user in the three types of swings. FIG. 2A shows the right-handed golfer at the initial "address" position looking at the ball spot (not shown). FIG. 2B shows the user at the full back swing position, the tether completely retracted. The rewind force of the CFU assists in pulling the golfers arms to full back extension. Accordingly, this exercise alone can result in improved flexibility and extension. FIG. 2C shows the user at the position just entering the impact zone. It is important to note that an extension of the tether toward the interlocked hands intersects or is near the interlock such that the constant force is felt in the grip by virtue of the design of the handle. FIG. 2D shows the same user having reversed position for the back swing, starting at the impact position. Note the door 5 is now on the right in the figure, which is to the golfer's left. FIG. 2E shows the user at the full follow through position, the rewind force of the CFU providing a pull that develops full arm extension on the follow through. In total, the constant force on the down swing and the rewind force on the back swing and the follow through develops increased range of movement, flexibility and muscle memory. Since the shank of the crook to which the tether is secured is free to pivot in the handle, it can be seen that cocking of the wrists out of the swing plane is resisted, thereby developing a constant, flat swing plane.

Figure 3A:
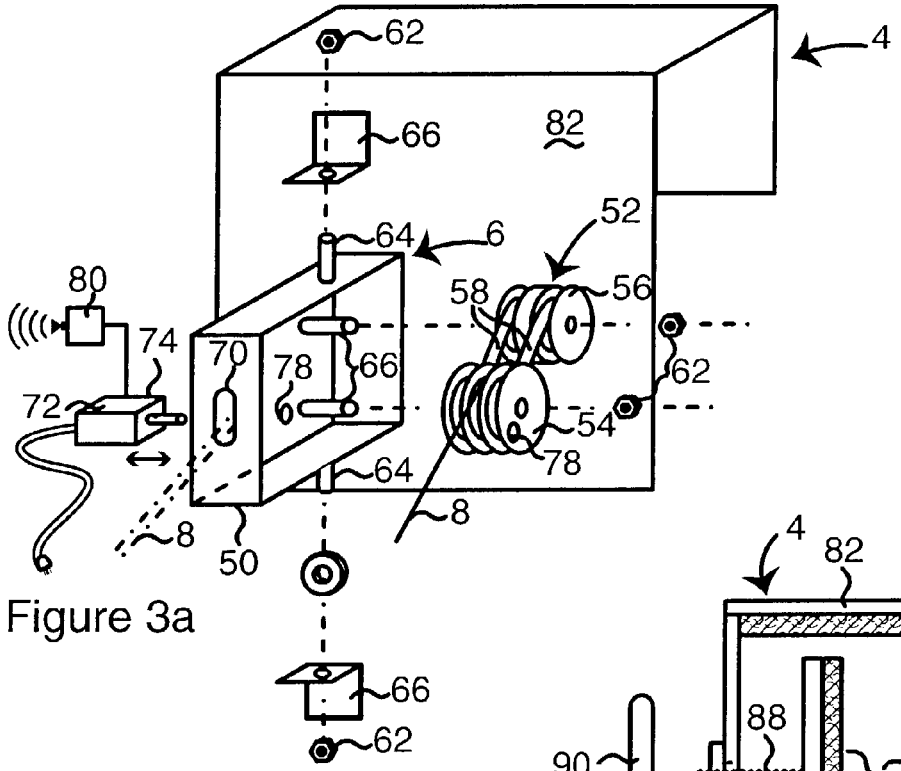
FIG. 3A is a partly exploded isometric drawing, schematic in nature, of a first embodiment of the inventive CFU attached to a door bracket mounting assembly and showing a single, reverse wound ribbon spring reels assembly, and features of control and stop systems.

FIG. 3A is a partly exploded isometric drawing, schematic in nature, of a first embodiment of the inventive CFU 6 attached to an over-the-door bracket mounting assembly 4 and showing a single, reverse wound ribbon spring assembly 52. The CFU assembly comprises a housing 50 having upper and lower pins 64 journaled in receiving holes of upper and lower brackets 64 which are secured to the outer plate of the bracket 82. Te pins can be secured with appropriate nuts 62. This pivot assembly permits the CFU to swivel from side to side as the swing plane is followed, so that the force on the handle is the constant force provided by unit 6 without extraneous external forces (friction, vector components) being introduced as in a fixed system.

Mounted internally of housing 50 is a reverse-wound ribbon spring assembly 52 that provides the constant force and a constant torque rewind function. The tether 8 is wound on the central spool of the output reel 54. Two outer reels receive springs 58 supplied from the supply reel 56. The springs are reverse-wound, that is, the spring 58 is wound counter clockwise (as shown looking from the right side of FIG. 3A) on the supply reel 56, and is led to the underside of the tether output reel 54 to be wound clockwise thereon. The counter winding provides constant resistive force (rotational torque on the reels) as the tether is extended, and constant rewind torque to reel in the tether and the handle. The natural condition of the CFU is "retracted", that is, the tether is wound on the center spool of the three-spool gang comprising the output reel. The supply reel has two outboard spools flanking a center drum, and the outboard spools are coordinate with the two outboard spools of the output reel for smooth winding and unwinding of the ribbon spring. One skilled in the art can select a suitable, commercially available ribbon spring assembly for length and service life; some 90 companies offer them in the United States under the heading of "Constant Force Springs." Any other constant force assembly may be employed, although ribbon spring types are presently preferred as the best mode for a CFU.

The spools are mounted on axles 50 and secured by nuts 62. Note housing 50 includes a slot 70 through which the tether 8 is fed, as shown in phantom on the left of the figure. A reel stop and lock assembly 72 may be provided as an option. This includes a stop solenoid having a reciprocating pin 74 that can extend through hole 76 in the housing to engage a hole 78 in the output reel 54. The stop/lock assembly may include a controller, such as a microprocessor or PLC, that can time the usage. When the usage time is nearing the end, an audio or visual message is broadcast or displayed on the annunciator unit 80 (sound being shown by way of example) warning the user that he/she only has a short time left. When the time is up, the solenoid pin 74 extends into the hole 78 in the reel, stopping the use. The next user, upon authorization, e.g. by paying a fee, causes the pin to retract and can exercise for the purchase time period, say 20 minutes.

Figure 3B:
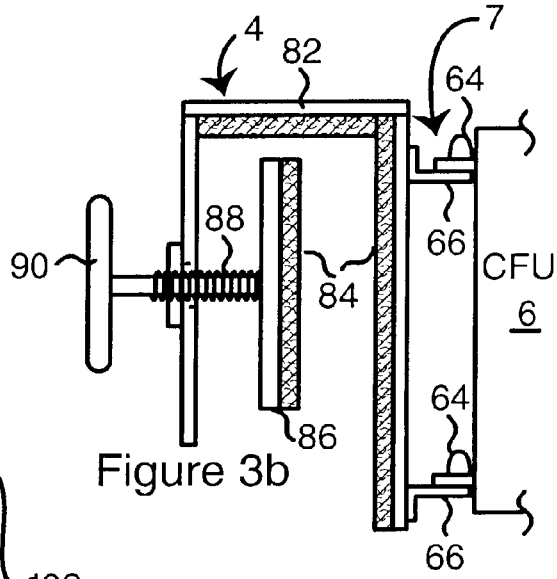
FIG. 3B is a side elevation view of the door bracket mounting system of FIG. 3A.

FIG. 3B is a side elevation view showing the detail of the door bracket-type mounting system 4 of FIG. 3A, this embodiment including pivot brackets 66 having integral pins 64. The CFU 6 includes flanges with holes so that they can be slipped down onto the pins. The inside faces of the inverted U-shaped bracket 82 preferably includes a felt, cork or rubber facing 84 to prevent scratching of the door and to provide good frictional contact so that the CFU does not vibrate or wobble during use. As shown, to compensate for doors of differing thickness, as pressure plate 86 having a threaded shank and knob 90 may be employed.

Figure 3C:
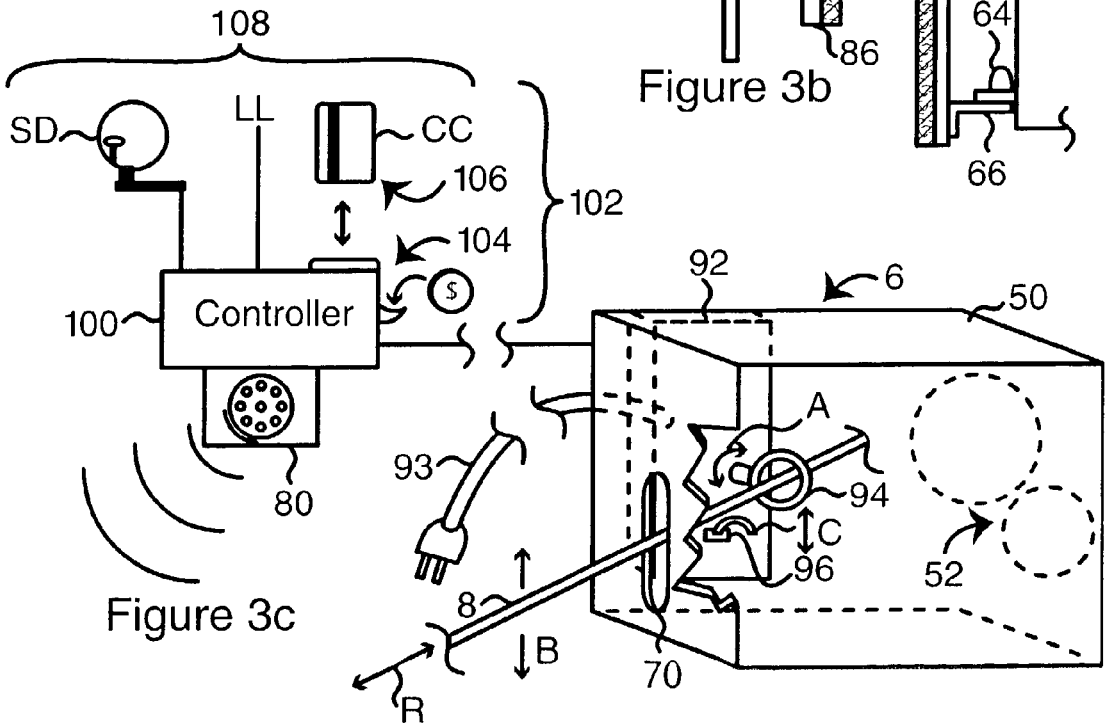
FIG. 3C is a schematic of a second embodiment of a CFU for automatic coin or credit card operation with on or off-site data link and an annunciator for advising the user.

FIG. 3C is a schematic of a second embodiment of a CFU 6 linked to a controller 100 for automatic operation upon payment by coin 104 or credit card 106, and including on or off-site data link 108, via Satellite Dish (SD) or Long or Local phone Line (LL). The external controller 100, or the internal controller 92 can include an annunciator 80 for advising the user of selected messages, such as start, time remaining, number of repetitions and the like. The controller 100 is wired to the CFU controller 92, that is powered via power cord 93. The internal control unit can include a rotatable ring brake 94, see arrow A, which functions to gradually increase resistance on the tether 8 as it is being unreeled. By a full rotation the tether can be completely stopped. The gradual increase in resistance permits the user to complete a swing with out a jarring stop. The swings can be counted by means of reed switch 96 that is triggered each time the swing reaches the low point, FIG. 2C, since the tether 8 moves from an upper high point at the top of the back swing to a lower point at which it contacts the reed switch at the bottom of the swing. The up and down motions of the tether and the switch are shown by arrows B and C, respectively, as the tether is extended and retracted, arrow R. The output reel 54 is shown in phantom.

Figure 4:
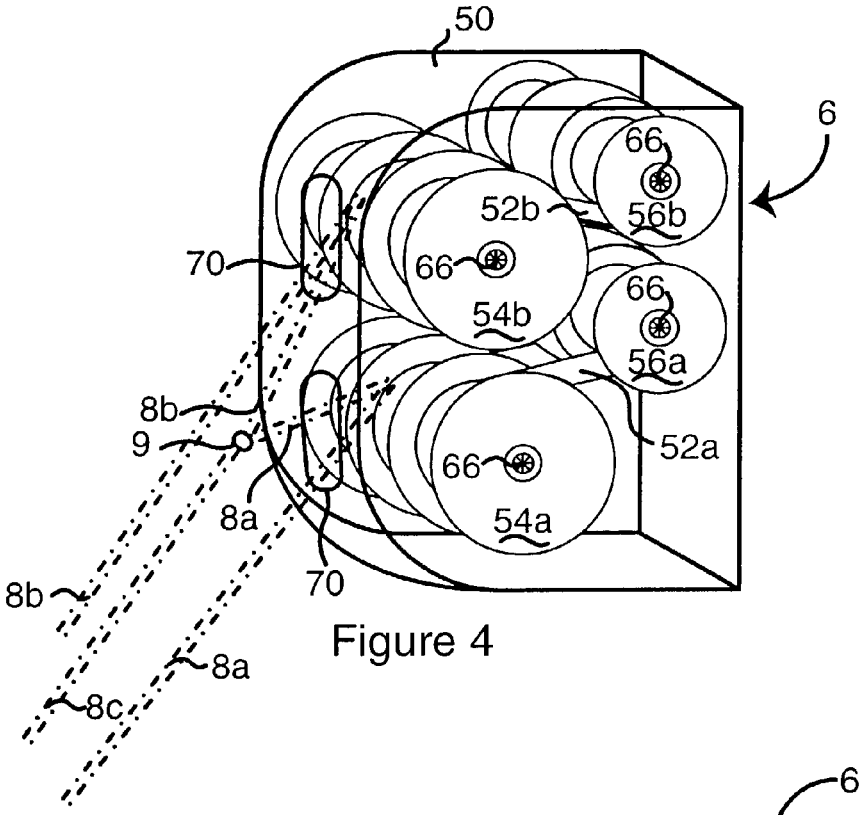
FIG. 4 is a schematic isometric showing the preferred embodiment of a selectable force CFU unit employing two sets of reverse wound spring reel system, each providing a different force, and the tethers of which may be linked to form an additive force so that the unit provides three different force levels.

FIG. 4 is a schematic isometric showing the preferred embodiment of a selectable force CFU unit employing two sets of reverse-wound spring reel systems 54*a*/56*a* and 54*b*/56*b*, each providing a different force, and the tethers of which 8*a* and 8*b*, passing through respective slots 70, may be linked at 9 external of the housing 50 to form an additive force on resulting linked tether 8*c* so that the unit provides three different force levels.

Figure 8:
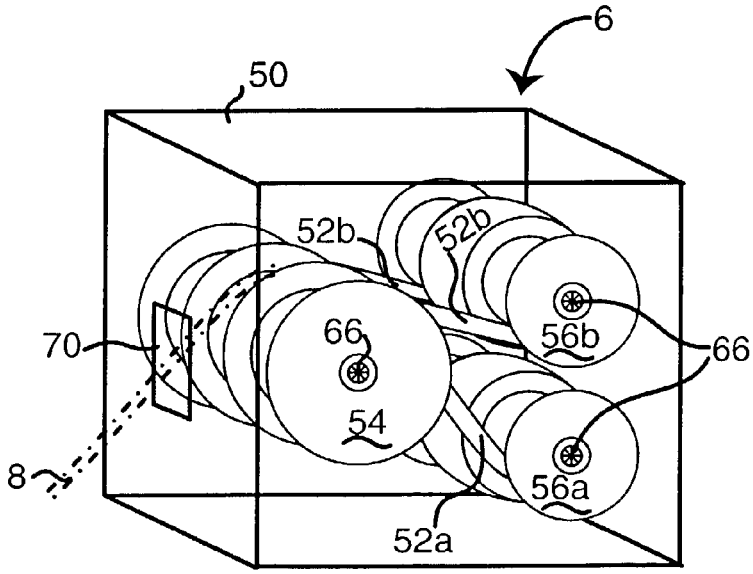
FIG. 8 shows another arrangement of the preferred reverse wound ribbon spring CFU in which three reels are employed, two spring supply reels from which the two springs are wound one on the other onto a single tether cable or line output reel.

FIG. 8 shows another arrangement of the preferred reverse wound ribbon spring CFU in which three reels are employed, two spring supply reels, 56*a* and 56*b*, from which the two springs are wound one on the other onto a single tether cable or line output reel 54. As shown, the ribbon springs 52*a* underlie the ribbon springs 52*b* and are wrapped onto the output reel 54. The force on the tether is inversely proportional to the diameter of the cable output reel; the smaller the diameter, the higher the force. It is important, therefore, to use small diameter tether so that the force does not change from layers of cable increasing the diameter substantially. Thus the preferred cable ranges from about 1/32" to about 1/8", and fine, high strength monofilament line is useful. To assist in preventing snarls, the filament line may be braided. Conversely, for a given torque, the diameter of the ribbon spring source spool is proportional to the number of cycles and to the thickness of the spring. The cable output spool diameter has to be larger than the spring spool diameter to maintain the selected force and rewind torque. Thus, to match the diameter requirements of the spools and prevent diameter enlargement due to build-up of the windings of the tether that would change the resistive force, use of layered springs is helpful.

FIG. 5 comprises a series of designs of handles 10, all shown with contoured grip 11. The handles of FIGS. 5A through 5D terminate in a shaft 12, preferably solid, that swivels, i.e., rotates as shown by arrow A. FIG. 5A shows a simple right angled swiveling shaft with a hole 33 to which the tether is linked. This serves to hold the tether so that it does not drag on the hands at the bottom of the swing. FIG. 5B shows a shepherd crook shaft 12 in which the crook is bent in three dimensions to bring the force to within or just forward of the interlock. FIG. 5C shows a short, dual axis pivoting tether link assembly, in which an eye 14 is pivotally secured to a collar 13 that rotates on shaft 12. The collar rotates as shown by arrow A, and the eye rotates on a axis orthogonal thereto as shown by arrow B. FIG. 5D show a pivoting eyelet design. FIG. 5E shows a contoured, self-centering guide 124 that is bent back to keep the tether away from the hands at the bottom of the swing and bring the force vector toward the interlock. FIG. 5F shows a fan-type tether guide comprising a slotted fan shaped member 126. At the top of the swing the tether position is shown in phantom, and at the bottom of the swing the tether 8 is shown in solid lines. FIG. 5G shows a spring-type tether link in which the spring 128 is stiff permitting limited side bending. FIG. 5H shows a stirrup-type handle, 46 and an eyelet 48 to which the tether is tied. This design is particularly suited for warm-ups, limbering exercises and rehabilitation.

Figure 6:
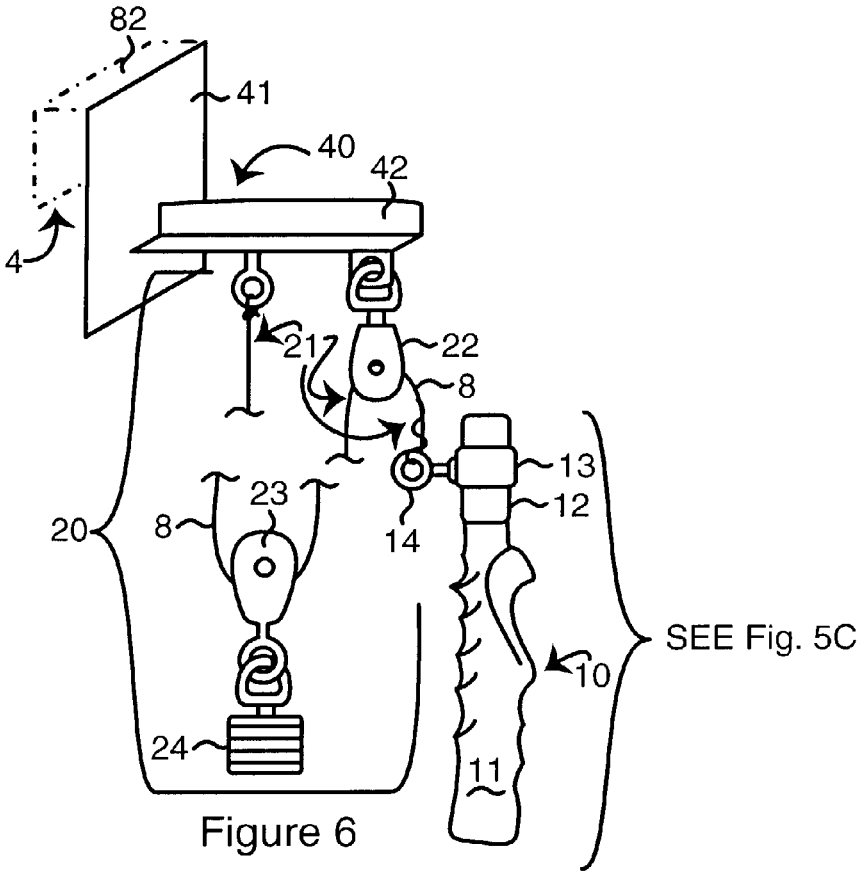
FIG. 6 shows a second embodiment of the CFU, in this case a double pulley mounted weight system employing the handle of FIG. 5C.
Figure 7:
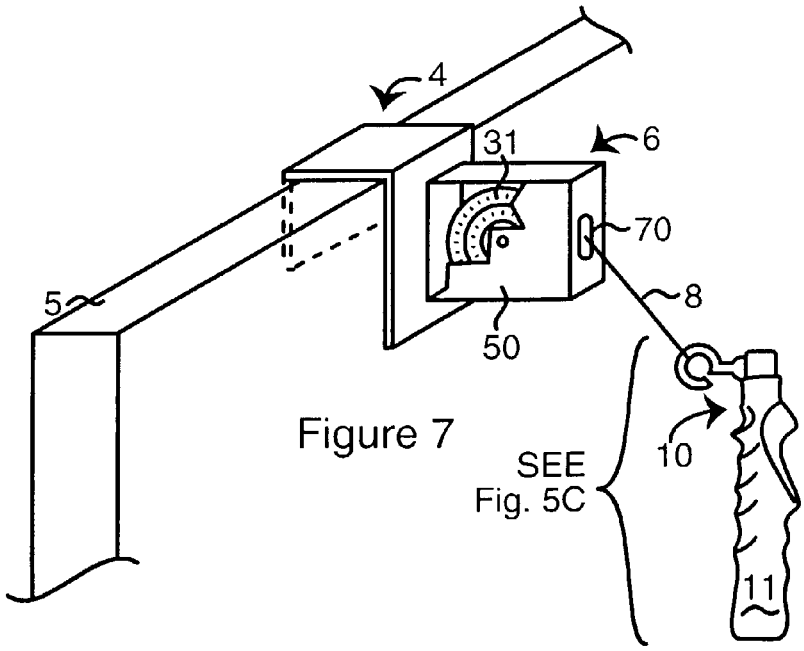
FIG. 7 shows a third embodiment of the CFU, in this case a reel that provides constant force through a suitable axial coil spring arrangement.
Figures 9A, 9B:
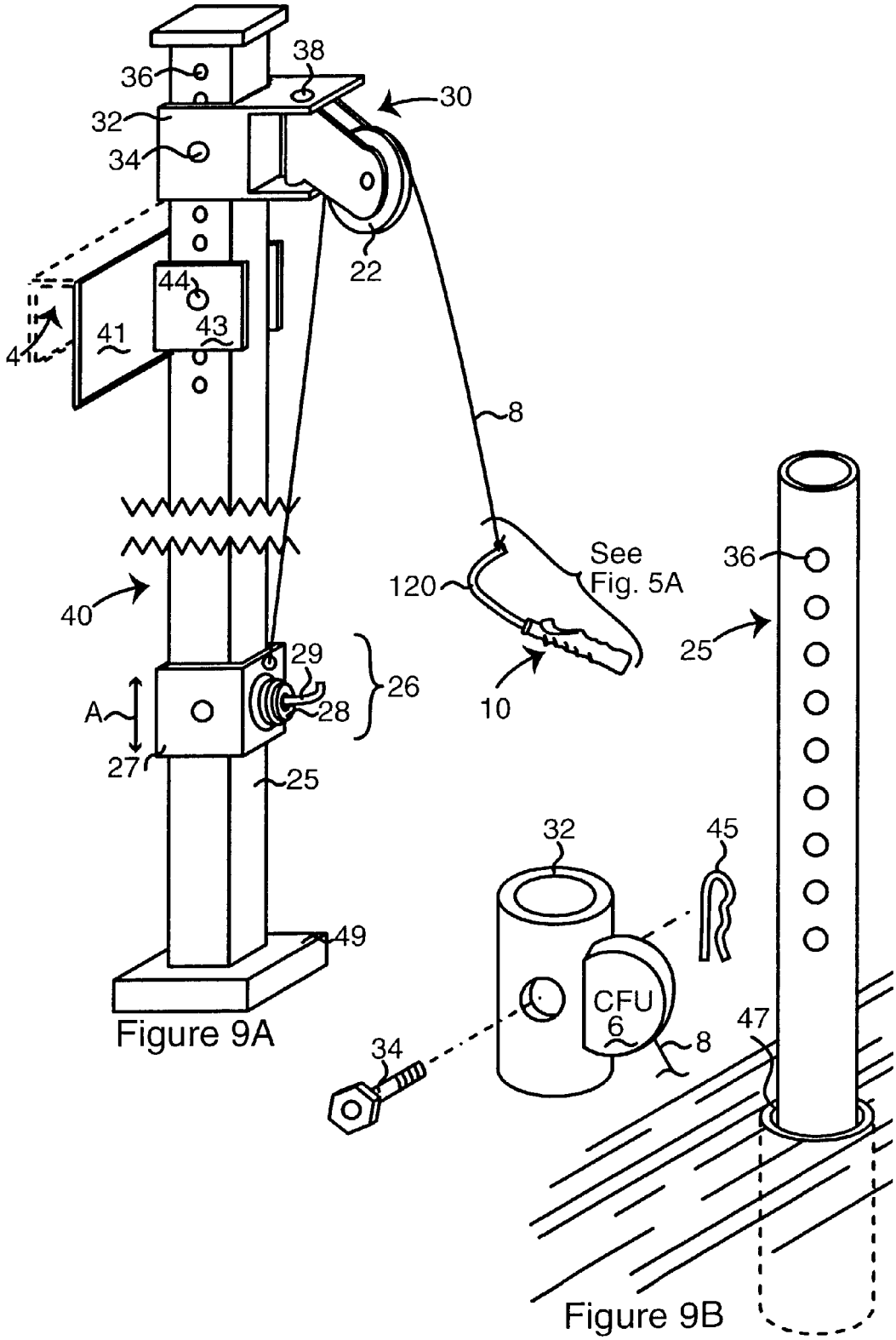
FIG. 9A shows another realization of the weight system embodiment, in this case a sliding weight unit mounted on a collar that slides vertically on a tube, in this case a square tube that may be door or wall mounted.
FIG. 9B shows a pipe mounted collar assembly for the CFU of the type of FIGS. 1–4, 8 and 11 permitting the CFU to be mounted free standing for out door use, such as at a driving range.

Referring now to FIGS. 6, 7 and 9A, with cross-reference to FIGS. 3B, 5A, and 5C, these related figures show alternate embodiments of the present invention. Handle 10 comprises grip 11 and shaft 12. Grip 11 may preferably comprise a grip shaped to constrain the user to grasp it in the well-known proper golf grip, such as the Matzie Training Grip, distributed by Matzie Golf Co. Inc., Palm Desert, Calif. or the Formed Grip, Part No.151, distributed by ShotSavers Golf, Inc., Nobleton, Fla. Collar 13 is rotatably attached to shaft 12, and attachment ring 14 is affixed to collar 13 by swivel means such as are well known in the art. Force-exerting means 20 is attached to handle 10 at attachment ring 14.

The force-exerting means in the alternate embodiment of FIG. 6 comprises a system of cord, weight and pulleys 20. Cord 21 is attached to attachment ring 14 by, for example, suitable knots or clamps, or other attachment means known in the art. Cord 21 runs through pulleys 22 and 23, and is attached to mounting means 40, again by knotting, clamping or other means known to the art. Cord 21 is preferably adjustable in length, to allow for different height of mounting means 40 and golfers of different height; such adjustment can readily be achieved by attaching cord 21 to mounting means 40 at the desired length, and cutting off excess cord or looping the excess over mounting means 40. Pulley 22 is equipped with a swivel and is attached to mounting means 40. Pulley 23 is attached to weight 24, which may be in the range of 5 to 50 lbs. Weight 24 is preferably adjustable by the user, depending on his/her strength and the magnitude of the force he/she considers effective for training purposes; for example, weight 24 may comprise a stack of individual weights of some integral sub-multiple of 50 pounds, such as 5 and/or 10 pounds; the weight being adjusted by the number of individual weights added to the stack. It will be appreciated that the force exerted on handle 10 in the FIG. 6 embodiment will be half of the weight 24, because of the mechanical advantage conferred by the pulley arrangement of pulleys 22 and 23.

Generally, the mounting means 40 comprises mounting plate 41 and supporting bracket 42. Mounting plate 41 is attached to a wall, door frame or other suitable sturdy stationary building member at a position somewhat higher than the user's height by any convenient fastening means, such as nails, glue, bolts or the like. More preferably, mounting plate 41 is bent in an inverted U-shape so it fits snugly over the top of a door, best seen as bracket 4 in FIGS. 3A, 3B and 7, preferably lined with felt or some similar non-marring material to protect the finish on the door on which it is mounted. The supporting bracket 42 of FIG. 6 may be attached to mounting plate 41 by welding or other means known to the art, but is more preferably detachably attached to plate 41, for example, by having a tongue or plate on bracket 42 which slides into a suitable track or slot on mounting plate 41.

FIG. 7 shows a third embodiment of the CFU 6, in this case a reel that provides constant force through a suitable axial coil spring arrangement 31. The. CFU is mounted on door 5 via an over-the-door bracket 4, and tether 8 is attached to a suitable handle, such as that of FIG. 5C.

The embodiment of FIG. 9A illustrates a tubular mount system 40 in which the weight system 20 comprises a collar 27 having weights 28 suspended on a rod bracket 29. The collar is free to slide up and down as show by the arrow. The tether 8 is secured to an eyelet on the collar 27, passes up and through the sheave of the pulley 22 of the pulley bracket system 30. The pulley swivels right and left on a pin journaled in the bracket 38, which in turn is supported on the vertically adjustable adjustable bracket 32 by pin 34 engaging a hole 34 in the tube 25 at an appropriate height off the ground. The tube 25 is supported on base 49 to prevent slippage and scoring the floor on which it is resting. A wall mount bracket 41 may be used to anchor the column 25. The bracket 42 includes a pair of brackets 43 between which the column 25 fits, and the pin 44 is used to secure the column to the retaining brackets 43. Alternately, an over-the-door bracket 4 may be used.

The following describes the use of the device of the present invention for a right-handed user; the changes necessary to extend the description to left-handed users will be self-evident from the descriptions above.

To use the device of the present invention, the right handed golfer stands next to the device, with the shoulders substantially parallel to the axis of bracket 42, the right shoulder closest to the device. The stance of the user is adjusted so that, with the golfer holding handle 10 in the correct position for the top of the backswing, weight 24 will be a short distance above the floor in order to exert a force on handle 10 at the extreme upper limit of the backswing. The user grasps handle 10, which emulates a golf club, by means of grip 11, pulls it down, and assumes a stance as if he/she were addressing a golf ball, that is, preparing to hit a golf ball. The correct address position is well known to golf players and is shown in FIG. 2C.

The user then allows the force exerted by force-exerting means 20 (the weight system) acting on handle 10 to draw the handle up and to the right, thereby turning the axis of the shoulders approximately 90° to the right. The hips follow, turning approximately 30–45° to the right. The user's arms are extended up and to the right, while being kept substantially in front of the axis of the shoulders. The user keeps the left arm substantially straight, and the head steady and fixed on the position a golf ball would occupy, during this operation. At this point, the wrists will be somewhat cocked or flexed so as to point handle 10 over the right shoulder. During this backswing, under the control of the device of the present invention, the user's body weight will naturally shift from being equally distributed on both feet, in the correct address position, to being preponderantly on the inside of the right foot at the upper limit of the backswing, which is the correct weight distribution for this phase of the golf swing. All of these movements and changes in body position and alignment are done by the user in response or reaction to the force exerted by force-exerting means 20 acting on handle 10. The effect of the device of the present invention is thus to induce and constrain the user to perform the backswing in the correct and most efficacious manner.

From this position, the user begins the practice downswing, turning the shoulders and hips to the left and pulling handle 10 down with the arms against the resistance of force-exerting means 20. The arms are kept in front of the axis of the shoulders. The upper arms are kept close to the body, the left arm straight, into the position of simulated impact on a golf ball. The body weight is shifted preponderantly to the left foot in the process. The wrists will be urged to remain cocked during this downswing operation by the resistive force on tether 21 until well into the impact area or bottom of the swing, at which time the right arm will straighten and wrists will uncock. Again, the effect of the device of the present invention is to induce and constrain the user to perform the downswing in the correct and most efficacious manner.

The user repeats this back swing-down swing sequence many times in a training session, and repeats the training session regularly, perhaps weekly or several times weekly. As a result of this repetition, under the control provided by the device of the present invention and against the resistance it exerts, signals from the proprioceptive nerves in the various muscles, joints, ligaments and tendons involved in the action will lead to the imprinting of the correct sequence of movements on the central nervous system. As a result, the correct backswing and down swing will become reflexive.

It is particularly instructive in many cases to perform this action, at least initially, under the tutelage of a golf instructor, and/or to monitor the action in a mirror or record it with a video camera and display the video, to insure that the backswing and downswing are being performed correctly.

The function of the device of the present invention is to pull, coax or guide the users body into the correct back swing position, then to provide resistance and further guidance for the down swing. Also, the device will significantly assist in preventing such golf swing errors as: a) over swinging in the back swing (i.e. swinging the club too far to the rear, so that the hands and golf club handle go behind the body at the end of the back swing); and b) reverse weight shift (i.e., shifting the weight to the left leg during the back swing). It also insures that the user's hands are kept in front of the axis of the shoulders during the back swing. Furthermore, the device prompts the user to exert force predominately with the muscles of the left side (lead side for a right-handed golfer) when initiating the down swing. The device also counteracts any tendency for right-side dominance in this phase of the swing, which could cause the golf club to depart from a truly planar swing (i.e., the golf club describing an arc in a flat plane throughout the golf swing), that is universally recognized as the optimum for the golf swing.

To assist the user in developing the musculature of the lead, non-dominant side, and imprinting the use of the non-dominant arm and shoulder muscles to provide the major portion of the power in the golf swing, handle 10 may preferably be interchangeable with stirrup-type handgrip 46 illustrated in FIG. 5H. Stirrup handle 46 also can be used for overhead exercises to increase strength and flexibility. In the preferred embodiment, cord 21 (tether 8) is detached from attachment ring 14 (FIG. 6) and reattached to the analogous attachment ring 48. Such detachment and reattachment is preferably facilitated by equipping the end of cord 21 with a releasable clip of the type well known in the art.

To make use of the handgrip 46 of FIG. 5H, the user stands in the golf address position, as before, grasps handle 46 with the left hand only (for a right-handed user), and, keeping the left arm substantially straight, allow force-exerting means 20 (e.g., CFU 6) to draw the left hand and arm to the right, and pull the axis of the shoulders to the right. The user then moves the left arm down, in a simulated downswing, against the resistance of force-exerting means 20; the left wrist is kept relatively straight during this action, as it would be at the moment of impact on the golf ball in an actual golf swing. This operation is repeated perhaps 30 times in a single session, and the session repeated weekly or several times weekly. The result of such use will be the strengthening of the left arm and shoulder muscles, and the imprinting on the user the proper use of the musculature of left arm and shoulder to produce the power in the downswing.

While the foregoing describes the preferred mode of practicing the invention, other embodiments are possible. For example, as shown in FIG. 7, force-exerting means 20 could comprise a spring or other extensible element 31 rather than a weight, the spring either acting directly or through a cord and a pulley such as pulley 22.

In an additional alternate embodiment, attachment ring 14 can be attached to the distal end of handle 10, as illustrated in FIG. 5D. An alternate embodiment employs a conventional golf club handle as handle 10, instead of comprising the grip-training portion 11 of handle 10 of the preferred embodiments.

In another embodiment, the force-exerting means is attached to a floor stand as seen in FIGS. 9A and 9B which supports the force-exerting means at a suitable height; the height of the support is adjustable, for example, by telescoping members with a locking mechanism. This latter embodiment obviates the necessity of attaching mounting plate 41 to a structure, or fitting it to a door.

In another embodiment of the present invention, illustrated in FIG. 7, force-exerting means 20 comprises a cable affixed to a spiral spring, such, as is used in self-retracting tape measures or electric cords. The cable is attached to handle 10. The force-exerting spring and retracted cable are contained in a suitable enclosure, which is equipped with a mounting plate 41.

In another embodiment, mounting plate 41, in the embodiment where it is fabricated to fit over the top of a door, is equipped with one or more screws, preferably equipped with wing-type heads and non-marring tips, or an adjustment knob and plate as shown in FIG. 3B, to affix mounting plate 41 to doors of different thickness.

Figure 10:
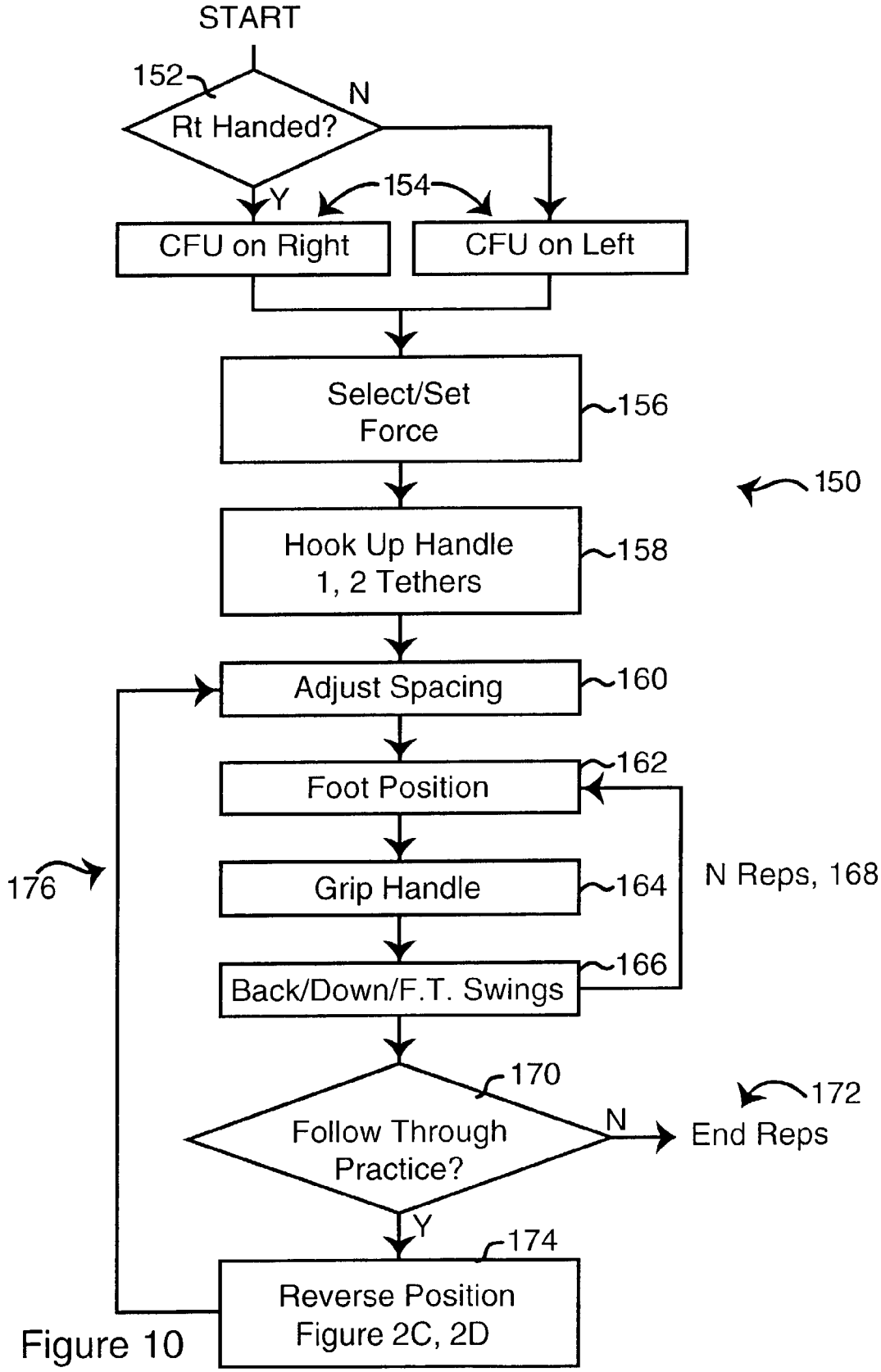
FIG. 10 is a flow sheet of a training regimen in accord with the inventive method aspects.

With respect to method aspects of the invention, FIG. 10 shows a flow sheet of a training regimen which can be best understood by referring to FIGS. 2A through 2C. Upon starting the training, the golfer, depending on his/her "handidness" 152, determines his/her orientation to the CFU, turning so the CFU is on the right if right handed and on the left if left handed, 154. The amount of force is selected and set on the CFU 156, and the handle is hooked up, 158, typically with a spring clip. Referring to FIG. 4, the force can be selected by choosing one or the other tethers 8*a*, 8*b*, or connecting them together as 8*c*. For example, 8*a* may be off a reel set having 5 lbs force, the 8*b* reel set has a spring force of 10 lbs, and the combination 15 lbs, used selectively by a young golfer, a woman or teen golfer and a mature or male golfer. The user then adjusts to the proper distance from the CFU, 160, positions the feet properly, 162, e.g., by the foot 'prints' on the training mat, and grips the handle 164 at the "address" position, FIG. 2C. The practice begins by selecting the swing to practice: Back swing, Down swing, Back followed by Down swing, or Follow Through, 166. The swing is continued through multiple reps 168, the user checking foot position and handle grip from rep to rep. Typically, the Back and Down swings are practiced first, sequentially. Then the user or coach determines if the Follow Through swing is to be practiced, 170. If not, the practice session ends 172. If so, the position of the golfer is reversed, 174, see FIGS. 2C and 2D. If the follow through is practiced 176, the cycle of spacing adjustment, foot positioning and handle grip are repeated, and the reps continue to the end of the practice session 172.

INDUSTRIAL APPLICABILITY

Figure 11:
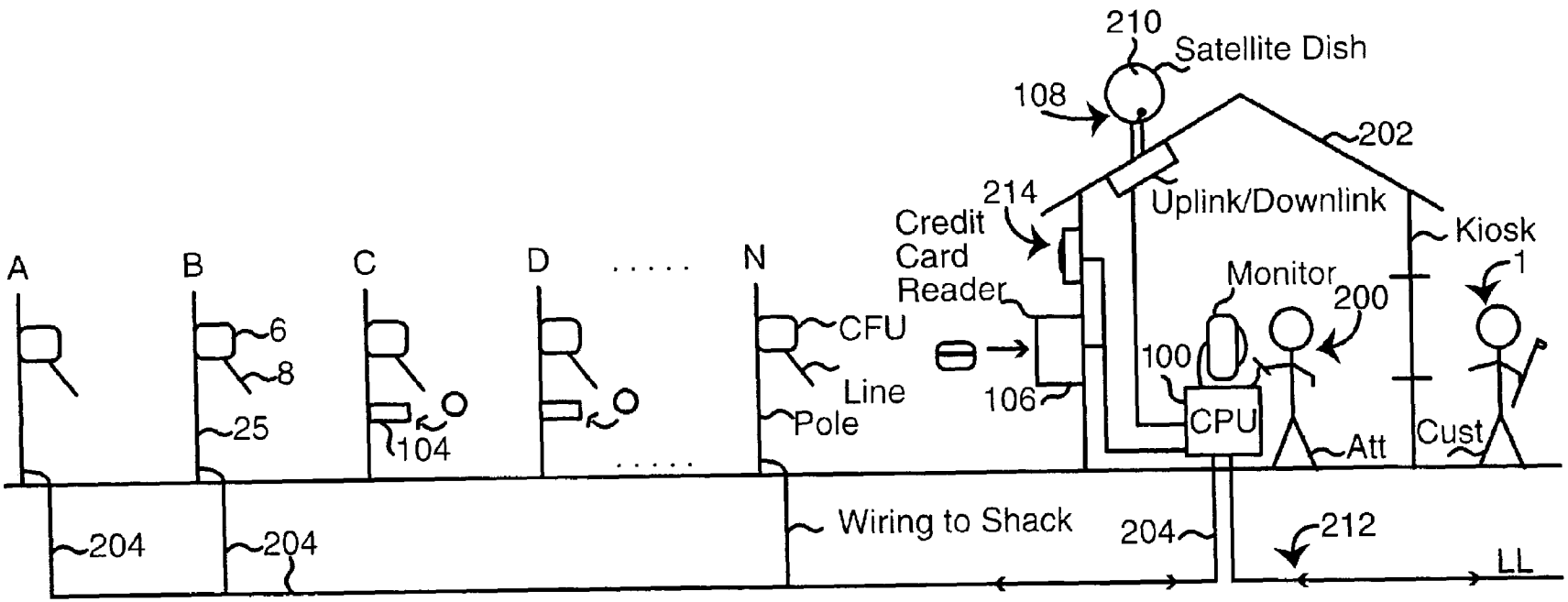
FIG. 11 is a schematic of both an on-site kiosk controlled system of the invention, and an Internet enabled method for a pay-for-use business model for training on the inventive constant force swing trainer devices.

It is clear that the inventive training device, system and method has wide applicability in the golf training field. For example, FIG. 11 is a schematic of both an on-site kiosk-controlled system of the invention, and an Internet enabled method for a pay-for-use business model for training on the inventive constant force swing trainer devices. For an on-site business, such as at a golf driving range or golf club, the customer 1 goes to the attendant 200 at the kiosk or office 202. The attendant enters the appropriate customer information, e.g., name, date, practice duration, cost and charge information into the CPU 100 via the keyboard, verifies the data entry on the monitor and assigns one of the free standing units A–N (see FIG. 9B) to the customer for the duration of the practice session (or for the number of reps dialed-in). The CPU automatically enables (unlocks) the selected unit via a signal to the control microprocessor or PLC in the CFU (see FIGS. 3A and 3C). For non-attended operation, the customer inserts his/her credit card into the reader 106 to enable the selected practice device A, B . . . N, and proceeds as described above for FIG. 10. Alternately, the customer can insert coins or bills into the pay-portal 104 at the practice tee device C, D . . . N as shown. It is preferred that the kiosk, especially where it is not attended, include a looping video displayed on a monitor or TV screen 214, demonstrating the steps for proper use of the swing trainer device. The user can push a button next to the screen marked "Demonstration" to observe prior to making the choice to use the trainers A . . . N, in FIG. 11.

Remote monitoring or control can be maintained via communication link 108, e.g., vial a satellite dish 210 linked to the kiosk CPU 100 and/or the CFU controller 72, 92 of FIGS. 3A and/or 3C, or via local or long distance telephone lines, cable, dedicated wiring 212. A website is created showing the locations, and includes a streaming video showing the device and its use. Via the website, the golfer 1 can: select a particular site; reserve practice and/or instructional time on a unit or with a golf pro; set up an account; arrange payment; receive instructional information; receive directions, tips and special offers on usage and other golf apparel, equipment and events; receive records of his practices and analytic and diagnostic reports from the device and/or his/her instructor(s), including videos of his/her practices, and the like.

It should be understood that various modifications within the scope of this invention can be made by one of ordinary skill in the art without departing from the spirit thereof and without undue experimentation. This invention is therefore to be defined by the scope of the appended claims as broadly as the prior art will permit, and in view of the specification if need be, including a full range of current and future equivalents thereof.

The invention claimed is:

1. A golf swing plane training device for a golfer user comprising in operative combination:

a) an anchor assembly, b) a constant force unit (CFU) assembly mounted via a pivot to said anchor and having a tether, i) said CFU is anchored to a support at a height above the highest extent of a golfer's hands at the top of a back swing, ii) said anchor and CFU pivot permitting pivoting of said CFU around a vertical axis during the performance by said user of a golf training swing;

iii) said constant force unit comprises a reverse-wound ribbon spring assembly selectable to have a non-straining force doing both the back swing and down swing in the range of less than about 20 lbs force during extension an retrac-tion, said assembly including a supply reel and an output reel mounted on an axle, said ribbon spring being wound one way in said supply reel with an outer end attached to said output reel axle for winding the opposite way around the output reel axle to provide smooth, truly constant force, contion-ous play out and rewind of said tether through-out the entire golf swing;

c) a tether comprising a line attached at one end to said CFU and having a length selected to provide a full golf swing from at least the top of a back swing through a down swing to an address position;

d) a handle unit attachable to the other end of said line for gasping by a user, said handle comprising;

i) a two-handed, contoured grip of a golf club without either the shaft or head of said club, and ii) an axially oriented, pivoting shank extending from an out-board end of said handle, said shaft including a distal end having an element to which said tether is attached, and said pivoting shank is configured to direct force from said tether to substantially the center of said said grip iii) said constant force unit and said axial handle shank, as they pivot during a golf swing, providing an upward and backward substantially constant force pull substantially on the center of said grip of said handle during both said back swing and during the entire down swing to said address position, a proper swing plane being a path of handle swing of least perceived resis-tance; and e) said golfer user positioning him/her-self with respect to said anchored CFU to provide an upward and backward substantially constant force pull directed substantially to the center of user's two handed grip on said contoured handle during said back swing to assist in full extension of the lead arm during said back swing, and substantially constant force during the entire down swing to said address position to promote lead shoulder dominance and arm muscle memory.

2. A golf swing plane training device as in claim 1 wherein said handle shank configuration includes at least one of: a rotatable ring to which the tether is attachable; a fixed ring to which the tether is attachable; a shepards-crook type shank member extending from one end of said handle; a contoured, self centering guide for said tether; a slotted fan type tether guide; arid a stiff, laterally bendable spring secured to one end of said handle.

3. A golf swing plane training device as in claim 1 wherein said an-chor includes at least one of a wall-mounted plate, an over-the-door-bracket; and a free standing pole mount.

4. A golf swing plane training device as in claim 1 wherein said reels provide at least two ribbon springs.

5. A golf swing plane training device as in claim 1 wherein said CFU includes at least one of a line brake, a reel stop, a pay station, a counter, or an annunciator associated with said device.

6. A golf swing plane training device as in claim 1 which includes a training mat having markings associated with usage.

7. A golf swing plane training device as in claim 1 which includes an instructional video instructing the user on proper use of the training device.

8. A golf swing plane training device as claim 1 wherein said constant force unit includes a plurality of reverse wound ribbon spring assemblies to provide constant force in selected increments ranging from about 4 to about 20 lbs of resistance so that said constant force unit can provide non-straining force of an amount suitable for users selected from men, women and children.

9. A golf swing plane training device as in claim 1 wherein said configured shank is bent back toward the grip of said handle.

10. A golf swing piano training device as in claim 9 wherein said configured shank is shaped generally like a shepard's crook.

11. A golf swing plane training device as in claim 1 which includes at least one controller linked to said CFU, said controller including a program structure permitting authorized use of said CPU.

12. A golf swing plane training device as in claim 11 wherein said controller is programmable to permit access on a pay-for-use basis including at least one of a period of use and number of swing repetitions.

13. A golf swing plane training device as in claim 12 wherein said controller is a co-located with said CFU.

14. A golf swing plane training device as in claim 12 which includes a pay station associated with said CFU for use payment by cash, token or credit.

15. A golf swing plane training device as in claim 12 wherein a plurality of said CFUs are placed in an array at a site, and said controller is located in at least one of on-site or remotely.

16. A golf swing plane training device as in claim 15 wherein said controller is remotely located and includes a CPU, input, display devices, and computer program structures for access, management, operation, analysis, reports and accounting functions.

17. A golf swing plane training device as in claim 16 wherein said controller includes computer programs for managing a website related to use of said swing plane training devices.

18. A golf swing plane training device as in claim 17 wherein said web site includes still and video images showing proper use of said device for swing plane training.

19. A golf swing plane training device as in claim 15 wherein said controller is located on-site and is programmable for at least one of automated or attendant monitored operation.

20. A golf swing plane training method for a golfer trainee comprising the steps of:

a) providing a constant force unit:

i) pivotally anchored to a support at an elevated position located at a height above the highest extent of a golfer-trainee's hands at the of a back swing, said anchor permitting pivoting of said constant force unit around a vertical axis during the performance by said trainee of golf swing, ii) said constant force unit including a tether and a handle at the end of the tether, iii) said handle comprising a two-handed, contoured grip of a golf club without the shaft or head of said club and an axially oriented pivoting shaft extending from an out-board end of said handle, said shaft including an outer end having an element to which said tether is attached, and said pivoting shaft is configured to direct force from said tether to substantially the center of said said qrip, and iv) said constant force unit comprises a reverse-wound ribbon spring assembly having a supply reel portion and an output reel mounted on an axle, said ribbon spring being wound one way in said supply reel with an outer end attached to said output reel axle for winding the opposite way around the output reel axle to provide smooth, truly constant force, continuous play out and rewind of said tether throughout the entire golf swing;

b) positioning said trainee in a proper golf address stance with respect to said constant force unit;

c) said trainee is positioned in a golf stance suited to the handedness of the trainee to grip said handle in a proper two-handed golf grip;

d) performing by said trainee of at least one of a back swing, a down swing to an address position and a follow through swing;

e) applying a constant force of less than about 20 lbs from said constant force unit to said handle while said trainee performs said swing, said constant force unit and said axial handle shaft as they pivot during a golf swing, providing an upward and backward substantially constant force pull substantially on the center of said grip of said handle during both said back swing to assist in full extension of the lead arm during said back swing, and during the entire down swing to said address position; and f) repeating by said golf trainee a path of least perceived resistance in said swing under said constant force a plurality of times continuously with smooth play out and rewind of said tether and under said constant force without strain during both the back swing and the don swing to assist in developing muscle memory of a proper golf swing plane and to assist in training the lead side to be dominant during at least the down swing.

21. Golf swing training method as in claim 20 wherein said configuration of said axial pivoting shaft in said handle comprises at least one bend back toward said two-handed grip position and said constant force unit includes plurality of reverse wound ribbon spring assemblies to selectively provide constant force in increments ranging from about 4 to about 20 lbs of resistance so that said constant force unit can provide non-straining constant force of an amount suitable for trainees selected from men, women and children.

* * * * *